US009309877B2

(12) United States Patent
Stein

(10) Patent No.: US 9,309,877 B2
(45) Date of Patent: Apr. 12, 2016

(54) CYLINDER ASSEMBLY FOR FLUID WORKING MACHINE

(75) Inventor: Uwe Stein, Lothian (GB)

(73) Assignees: ARTEMIS INTELLIGENT POWER LIMITED, Loanhead (GB); DANFOSS POWER SOLUTIONS APS, Nordbord (DK)

( * ) Notice: Subject to any disclaimer, the term of this patent is extended or adjusted under 35 U.S.C. 154(b) by 310 days.

(21) Appl. No.: 13/390,922

(22) PCT Filed: Aug. 3, 2011

(86) PCT No.: PCT/JP2011/004413

§ 371 (c)(1),
(2), (4) Date: Mar. 15, 2013

(87) PCT Pub. No.: WO2013/018146

PCT Pub. Date: Feb. 7, 2013

(65) Prior Publication Data

US 2013/0177464 A1 Jul. 11, 2013

(51) Int. Cl.

| | |
|---|---|
| ***F04B 39/10*** | (2006.01) |
| ***F04B 1/04*** | (2006.01) |
| ***F04B 53/10*** | (2006.01) |

(52) U.S. Cl.

CPC ..... *F04B 39/10* (2013.01); *F04B 1/0421* (2013.01); *F04B 39/1013* (2013.01); *F04B 39/1033* (2013.01); *F04B 53/10* (2013.01)

(58) Field of Classification Search

CPC .... F04B 53/109; F04B 53/166; F04B 49/225; F04B 41/04; F04B 39/10; F04B 39/1013; F04B 10/1033; F15B 15/1423; F16J 10/02

USPC ..... 417/297, 298, 552, 236, 237, 505, 509, 417/440, 441, 553; 92/169.1; 29/888.4, 29/888, 888.02

See application file for complete search history.

(56) References Cited

U.S. PATENT DOCUMENTS 1,489,912 A * 4/1924 Winkler ..... 417/298
5,037,277 A 8/1991 Tan (Continued)

FOREIGN PATENT DOCUMENTS

CA 2 678 983 A1 3/2011
CN 101086166 A 12/2007

(Continued)

OTHER PUBLICATIONS

DE 10 2008040088 with English Machine Translation, Boecking, High Pressure Pump, Jan. 2010.*

(Continued)

*Primary Examiner* — Devon Kramer
*Assistant Examiner* — Kenneth J Hansen
(74) *Attorney, Agent, or Firm* — Hauptman Ham, LLP

(57) ABSTRACT

Disclosed is a cylinder assembly for a fluid-working machine. The assembly includes a body having a first end and a second end. The body further includes a cylinder, a poppet valve seat and a face-sealing annular valve seat. The cylinder is open to the first end and configured to receive a reciprocating piston. The poppet and annular valve seats extend around an axis through the cylinder. An annular valve including the annular valve seat and an annular valve member extends around the cylinder. Thus, the cylinder assembly is compact.

20 Claims, 4 Drawing Sheets

(56) References Cited

U.S. PATENT DOCUMENTS

| | | | | |
|---|---|---|---|---|
| 5,259,738 | A | 11/1993 | Salter et al. | |
| 5,562,430 | A | 10/1996 | Schuller et al. | |
| 6,158,402 | A | 12/2000 | Taguchi et al. | |
| 2007/0071614 | A1 | 3/2007 | Inoue | |
| 2008/0213114 | A1* | 9/2008 | Miller | 417/521 |
| 2011/0020159 | A1 | 1/2011 | Kuttler | |
| 2011/0123354 | A1 | 5/2011 | Stein et al. | |

FOREIGN PATENT DOCUMENTS

| | | | |
|---|---|---|---|
| DE | 10 2008 040 088 | A1 | 1/2010 |
| EP | 0361927 | A1 | 4/1990 |
| EP | 0 410 545 | A1 | 1/1991 |
| EP | 0494236 | A1 | 7/1992 |
| EP | 1537333 | A1 | 6/2005 |
| GB | 190927327 | | 0/1909 |
| JP | 3117688 | A | 5/1991 |
| JP | 2010502886 | A | 1/2010 |
| WO | 2009056138 | A1 | 5/2009 |
| WO | 2010/073040 | A1 | 7/2010 |

OTHER PUBLICATIONS

International Preliminary Report on Patentability mailed Feb. 13, 2014, corresponds to PCT/JP2011/004413.

Office Action mailed Apr. 1, 2014, corresponds to Japanese patent application No. 2012-508705.

Decision to grant a patent mailed Jun. 6, 2014, corresponds to Japanese patent application No. 2012-508705.

Office Action mailed Nov. 4, 2014, corresponding to Chinese patent application No. 201180035078.1.

International Search Report issued in PCT application No. PCT/JP2011/004413 on May 29, 2012.

* cited by examiner

CYLINDER ASSEMBLY FOR FLUID WORKING MACHINE

RELATED APPLICATIONS

The present application is National Phase of International Application Number PCT/JP2011/004413, filed Aug. 3, 2011.

TECHNICAL FIELD

The invention relates to the field of fluid working machines, and in particular to the structure of cylinder assemblies and their component parts, for fluid working machines which comprise at least one working chamber of cyclically varying volume, in which the net displacement of fluid through the or each working chamber is regulated by at least one valve in communication with each of a high pressure manifold and a low pressure manifold, on a cycle by cycle basis, to determine the net throughput of fluid through the or each working chamber.

BACKGROUND ART

Fluid working machines include fluid-driven and/or fluid-driving machines, such as pumps, motors, and machines which can function as either a pump or as a motor in different operating modes. Although the invention will be illustrated with reference to applications in which the fluid is a liquid, such as a generally incompressible hydraulic liquid, the fluid could alternatively be a gas.

When a fluid working machine operates as a pump, a low pressure manifold typically acts as a net source of fluid and a high pressure manifold typically acts as a net sink for fluid. When a fluid working machine operates as a motor, a high pressure manifold typically acts as a net source of fluid and a low pressure manifold typically acts as a net sink for fluid. Within this description and the appended claims, the terms "high pressure manifold" and "low pressure manifold" refer to manifolds with higher and lower pressures relative to each other. The pressure difference between the high and low pressure manifolds, and the absolute values of the pressure in the high and low pressure manifolds will depend on the application. For example, the pressure difference may be higher in the case of a pump which is optimised for a high power pumping application than in the case of a pump which is optimised to precisely determine the net displacement of fluid, for example, which may have only a minimal pressure difference between high and low pressure manifolds. A fluid working machine may have more than one low pressure manifold.

Fluid working machines are known which comprise a plurality of working chambers of cyclically varying volume, in which the displacement of fluid through the working chambers is regulated by electronically controllable valves, on a cycle by cycle basis and in phased relationship to cycles of working chamber volume, to determine the net throughput of fluid through the machine. For example, EP 0 361 927 disclosed a method of controlling the net throughput of fluid through a multi-chamber pump by opening and/or closing electronically controllable poppet valves, in phased relationship to cycles of working chamber volume, to regulate fluid communication between individual working chambers of the pump and a low pressure manifold. As a result, individual chambers are selectable by a controller, on a cycle by cycle basis, to either displace a predetermined fixed volume of fluid or to undergo an idle cycle with no net displacement of fluid, thereby enabling the net throughput of the pump to be matched dynamically to demand. EP 0 494 236 developed this principle and included electronically controllable poppet valves which regulate fluid communication between individual working chambers and a high pressure manifold, thereby facilitating the provision of a fluid working machine functioning as either a pump or a motor in alternative operating modes. EP 1 537 333 introduced the possibility of part cycles, allowing individual cycles of individual working chambers to displace any of a plurality of different volumes of fluid to better match demand.

Fluid working machines of this type require rapidly opening and closing electronically controllable valves capable of regulating the flow of fluid into and out of a working chamber from the low pressure manifold, and in some embodiments, the high pressure manifold.

Fluid working machines of this type are typically modular, permitting various components to be assembled and disassembled, for example for maintenance or replacement of worn parts. Furthermore, it is advantageous for parts or modules or assemblies which most frequently need to be replaced or repair, to be accessible without substantial disassembly of the fluid working machine as a whole.

FIG. 1 is a schematic diagram of a fluid working machine of the general type discussed above, shown generally as 200, incorporating the illustrated valve assembly 202 as a high pressure valve, which regulates the flow of hydraulic fluid between a high pressure manifold 204 and a working chamber 206. The working chamber is defined by the interior of a cylinder 208 and a piston 210 which is mechanically linked to the rotation of a crankshaft 212 by a suitable mechanical linkage 214, and which reciprocates within the cylinder to cyclically vary the volume of the working chamber. A low pressure valve 216 regulates the flow of hydraulic fluid between a low pressure manifold 218 and the working chamber. The example fluid working machine includes a plurality of working chambers and mechanically linked to the rotation of the same crankshaft, with appropriate phase differences. A shaft position and speed sensor 220 determines the instantaneous angular position and speed of rotation of the shaft, and transmits shaft position and speed signals to a controller 222, which enables a controller to determine instantaneous phase of the cycles of each individual working chamber. The controller is typically a microprocessor or microcontroller which executes a stored program in use. The low pressure valve is electronically actuatable, and the opening and/or the closing of the high and low pressure valves is under the active control of the controller.

The example fluid working machine is operable to function as either a pump or a motor in alternative operating modes. When operating as a pump, low pressure fluid is received from the low pressure manifold, and output through the high pressure valve to the high pressure manifold. Shaft power is therefore converted into fluid power. When operating as a pump, high pressure fluid is received from the high pressure manifold, and output through the low pressure valve to the low pressure manifold. Fluid power is therefore converted into shaft power.

The controller regulates the opening and/or closing of the low and high pressure valves to determine the displacement of fluid through each working chamber, on a cycle by cycle basis, in phased relationship to cycles of a working chamber volume, to determine the net throughput of fluid through the machine. Thus, the fluid working machine operates according to the principles disclosed in EP 0 361 927, EP 0 494 236, and EP 1 537 333, the contents of which are incorporated herein by virtue of this reference.

Known cylinder assemblies for machines of this type have poppet valves, for example low and high pressure face sealing valves, such as poppet valves, located at the end of the cylinder furthest from the cam which drives the pistons. It is known for one of these face sealing valves, for example the high pressure valve (which regulates the flow of fluid between the cylinder and the high pressure manifold) to be an annular valve. This may be advantageous in some circumstances as it potentially allows relatively high flow rates. However, an annular valve located at the end of the cylinder further from the cam consumes a significant amount of volume, and so limits the extent to which the cylinder assembly can be compact. Thus, the invention addresses the technical problem of providing a compact cylinder assembly including an annular valve.

Furthermore, high rates of wear are known to occur at various parts of a fluid working machine, including certain parts associated with each working chamber; the cylinder (due to motion of the piston in use), the valves and the valve members. Therefore, these parts must be provided with increased strength and/or hardness so as to reduce the rate of wear. In known fluid working machines, one or more of these parts are either incorporated into a cylinder block or are difficult to access. For example for "monoblock" machines (such as the combustion engine shown in U.S. Pat. No. 6,158,402, or the pump of US 2007/0071614), the cylinder head (or crank case) and cylinder block are combined into one casting. Thus, wear of one or more of the cylinder or the valve seats requires replacement of the entire cylinder head or crank case (as the case may be) which is time consuming and expensive.

Even where certain parts may be made relatively easily accessible and replaceable (for example the valve members of the pump of US 2007/0071614) such ease of access is provided at the expense of economy of space, such that a multi-cylinder fluid working machine having such configuration is restricted in terms of geometry or minimum overall size.

Alternatively, the disassembly of the various components may be possible but extremely time consuming. For example, the hydraulic brake pump of U.S. Pat. No. 5,562,430 (for which the high pressure valve seat is part of a sub assembly, the low pressure valve seat and piston are part of a second sub assembly and wherein the sub assemblies installed within a body) requires substantial disassembly of the pump element in order to access the high pressure valve member or high pressure valve seat.

The cylinder assembly and cylinder body of the present invention are of particular benefit in connection with fluid working machines of this type and overcome the disadvantages of known fluid working machines mentioned above.

SUMMARY OF INVENTION

According to a first aspect of the invention there is provided a cylinder assembly for a fluid-working machine, comprising a cylinder body, a first valve having a first valve member and a second, face-sealing annular valve having a second, annular valve member;

the body having a first end and a second end and comprising a cylinder, a first valve seat and a second, face-sealing annular valve seat;

the cylinder open to the first end and configured to receive a reciprocating piston;

the first valve seat extending around a cylinder axis extending between the first and second ends and comprising one or more first valve apertures, the or each first valve aperture extending through the body and in communication with the cylinder and providing a fluid pathway through the body;

the second, annular valve seat comprising at least one annular sealing surface and a plurality of apertures for an annular valve, each aperture associated with a said sealing surface;

wherein the apertures of the second, annular valve seat are arranged around the axis and in communication with the cylinder, and provide a fluid pathway through the body;

the first valve seat and the first valve member together forming the first valve; and the second, annular valve seat and the second, annular valve member together forming the second, face-sealing annular valve.

Thus, as the apertures of the second, annular valve seat are arranged around the axis and in communication with the cylinder, and provide a fluid pathway through the body, the second, face-sealing annular valve is formed around the cylinder body, which is a compact arrangement. Preferably, the second, annular valve member extends around the cylinder. The second, annular valve member may be in the form of a band extending around the cylinder.

Preferably, the body, comprising the or each annular valve sealing surface and the or each first sealing surface and the cylinder, is a continuous unitary structure.

By a continuous unitary structure we mean a structure formed of a single piece of material (typically metal) and lacking discontinuities such as welds between parts, or bonds between parts formed by adhesives or fixings (e.g. bolts, screws, threadable connections and the like). The cylinder body may be part of a cylinder assembly comprising further pieces of material or apparatus, which may be secured to the body (for example by one or more fixings, or welds) but which do not form part of the body.

The cylinder is axially symmetric about the cylinder axis. Thus the portion of the body defining the cylinder is typically also axially symmetric about the cylinder axis. In some embodiments, the entire body is axially symmetric about the cylinder axis.

A fluid working machine comprises at least one (and typically a plurality of) working chambers, each defined by a reciprocating piston in a cylinder. Each working chamber communicates via a high pressure valve (such as an annular valve) to a high pressure manifold and via a low pressure valve (such as a poppet valve) to a low pressure manifold. In order to provide parts with acceptable working lifetimes, at least the high and low pressure valve seats and the cylinder must be hardened (by which we mean comprising or consisting of, or coated with a hard or hardened material such as hardened steel).

Typically, hardening requires the use of more costly materials, or one or more additional processing steps. The cylinder body of the present invention comprises all of the components which are required to be hardened and may thus be subject to a single hardening treatment, or be machined or otherwise manufactured from a single piece of hardened material.

Furthermore, a single unitary structure may be provided having greater overall strength than a comparable structure manufactured by joining (for example by welding or fixing together) separate structural units. A unitary structure is better able to withstand forces applied during use (e.g. from high pressure fluid), as stress is not focussed at joins or junctions between structural units. Thus, a cylinder body having the required strength may be constructed using less material and may therefore be more compact than has previously been possible, and this facilitates the construction of a more compact and more efficient fluid working machine.

Preferably, the cylinder, first valve seat and annular valve seat are coaxial. Accordingly, stresses received by the body in use (e.g. from fluid pressure) are distributed as evenly as possible. Preferably also, the body is generally circularly symmetric and the valve seats and cylinder are preferably circularly symmetric.

Typically, the first valve seat and the second, annular valve seat have different geometries or dimensions. In a fluid working machine, fluid flow between each of a high and a low pressure manifold and the cylinder must be controlled, and the optimal valve arrangement between the high pressure manifold and the cylinder, and the low pressure manifold and the cylinder, may differ. For example, the first valve seat may be a valve seat for a low pressure valve, such as a poppet valve (i.e. a valve having a single aperture and a moveable valve member operable to seal the aperture—typically having a head sized to cooperatively engage with the valve seat, and a stem extending therefrom to guide the motion of the valve member).

The first valve seat may be a poppet valve seat (typically comprising or more typically consisting of a single sealing surface), defining an aperture extending through the body and in communication with the cylinder. In alternative embodiments, the first valve seat may be an annular valve seat comprising two concentric sealing surfaces and a plurality of apertures therebetween.

The poppet (or first) valve seat typically has a smaller circumference than the or each annular valve sealing surface.

In some embodiments, the annular valve seat comprises a first sealing surface having a first circumference, and a second sealing surface having a second circumference which is greater than the first circumference, and wherein the said apertures for an annular valve are between the first and second sealing surfaces. Typically, a plurality of apertures are associated with a said sealing surface. For example, there may be first and second sealing surfaces and a plurality of apertures between the first and second sealing surfaces, each aperture being thereby associated with each sealing surface. However, alternative arrangements are possible.

In some embodiments, the first and second sealing surfaces are axially spaced apart; i.e. the first and second sealing surfaces are different distances along the cylinder axis from the first or second ends. In a preferred embodiment, the first sealing surface is between the second sealing surface and the first end, such that the annular valve seat faces in a direction having a component towards the first end (and an orthogonal component facing away from the cylinder axis).

The body may be a metal casting. The body may be machined from a single piece of material. For example, the body may be cast and subsequently one or more portions (such as the valve seats) machined. Alternatively, the body may be machined from a single piece of material, which may or may not be a single piece of material which has been cast. In some embodiments, the body is formed of hardened steel. In some embodiments, the body is formed from steel and one or more portions hardened (i.e. subjected to a hardening process such as annealing, quenching or tempering). In embodiments wherein the body is machined, the body may in addition be hardened and is typically subject to one or more hardening processes after machining.

Alternatively, or in addition, the body may be surface or case hardened (for example carburised or nitrided). One or more surfaces of the body may, in some embodiments, be provided with a friction reducing or hard coating. For example, the internal surface or surfaces of the cylinder may be provided with a low friction and/or wear resistant coating (such as a ceramic, e.g. titanium nitride, coating) and the said valve seats may be provided with hard and/or wear resistant coating (such as, tungsten carburising, ball peening, roller burnishing, diamond-like-carbon, PTFE (e.g. Teflon brand PTFE), or any other suitable surface coating).

In some embodiments, the poppet valve aperture (or each said first valve aperture) extends through the body and is in communication with the cylinder and the second end. The poppet valve aperture (or each said first valve aperture) may extend through the second end. In some embodiments, the poppet valve aperture (or each said first valve aperture) is in communication with the cylinder and a fluid pathway (or more than one fluid pathway) extending through the body in the vicinity of the second end. For example, in use, the poppet valve aperture may communicate with one or more apertures connected to a low pressure manifold of a fluid working machine, the apertures extending generally radially through the body in the vicinity of the second end.

Preferably, the maximum diameter of the poppet valve aperture is equal to or smaller than the minimum internal diameter of the cylinder. Thus, a poppet valve member may be introduced to the first end via the cylinder, so as to form a poppet valve. In use, the poppet valve so formed typically regulates the flow of fluid between a low pressure manifold and a working chamber, the working chamber defined by a reciprocating piston within the cylinder.

In use, a fluid working machine may comprise working chambers each having an electronically controllable valve for regulating the flow of fluid between the high or (more typically) low pressure manifold and the working chamber. Thus, the poppet valve of a said working chamber may, in some embodiments, be electronically controllable, and the cylinder body adapted for use with an electronically controllable poppet valve member. Accordingly, the cylinder body may comprise a flux bridge extending around the axis, the flux bridge preferably having an internal diameter which is the same or more preferably smaller than the diameter of the poppet valve aperture, such that a poppet valve member may be introduced to the first end via the cylinder, so as to form an electronically controllable poppet valve.

A flux bridge is a structure comprising a magnetically permeable material for communicating magnetic flux, caused by the energising of a coil, from the cylinder body to the poppet valve member (or the valve member of any other electronically controllable valve). A flux bridge typically comprises a metallic material and may be formed from the same material as, and/or a part of the cylinder body. The flux bridge typically defines a radial path for flux to pass between the cylinder body and the poppet valve member (or the valve member of any other electronically controllable valve), and thus movement of the poppet valve member along the axis of the cylinder does not substantially change the gap between the flux bridge and the poppet valve member.

In some embodiments, the body comprises a high pressure fluid receiving surface configured to be in fluid communication with the high pressure manifold of a fluid working machine, in use; the high pressure fluid receiving surface comprising a region facing in a direction having a component towards the second end of the body. The high pressure fluid receiving surface may be an external surface of the body.

In use of the cylinder body in a fluid working machine, a working chamber is defined by a reciprocating piston within the cylinder. The cylinder body must typically withstand high, and in some cases extremely high, fluid pressures within the working chamber during normal operation of the fluid working machine. Fluid pressure thus applies forces on the cylinder body acting outwardly and towards the second end, placing the cylinder body under stress. In embodiments wherein the annular valve seat (of a high pressure annular valve regulating flow of fluid between a high pressure manifold and the working chamber) faces in a direction having a component towards the first end, the components of forces towards the second end are further increased by the action of high pressure fluid from the high pressure manifold bearing on the annular valve member and thus the annular valve seat.

The cylinder body of the present invention is provided with a high pressure fluid receiving surface, which is placed in fluid communication with a high pressure manifold, in use. Forces transmitted to the body by high pressure fluid on the region of the high pressure fluid receiving surface facing in a direction having a component towards the second end will have a component towards the first end which opposes the components of force towards the second end resulting from fluid pressure bearing on the annular valve seat (and, at some stages during operation, resulting from high pressure within the working chamber). Consequently the net forces acting on the cylinder body are reduced.

The body may therefore be constructed using less material than has previously been possible. A smaller and more compact cylinder body enables the construction of a smaller and more compact fluid working machine. Furthermore, in embodiments having one or more electronically controlled valves, the reduction in the amount of material required to construct the cylinder assembly enables improved electromagnetic efficiency.

Typically, the exterior of the body comprises a high pressure fluid receiving surface region (comprising one or more high pressure fluid receiving surfaces) extending between a first external seal extending around the body between the annular valve seat and the first end, and a second external seal extending around the body between the second end and the first seal (typically between the annular valve seat and the second end.)

The said external seals describe a respective first area and second area in projection on a plane perpendicular to the cylinder axis, wherein the first and second areas are approximately equal, for example within 5% of each other. Typically, the high pressure fluid receiving surface region has a minimum or a maximum of area in projection on a plane perpendicular to the cylinder axis, intermediate the said external seals, which is different to (and preferably smaller than) the first and second areas.

Preferably the second, annular valve seat is between the first and second external seals.

When the body is installed in a fluid working machine (typically as a component part of a cylinder assembly) the said external seals engage with the fluid working machine, optionally via a sealing member, so as to bound the high pressure fluid receiving surface region of the body (typically of the exterior of the body) which is in fluid communication with the high pressure manifold, in use. The seals may, for example, comprise grooves or ridges, for example peripheral ridges of resilient material.

In use, the cylinder body receives components of force parallel to the cylinder axis in the direction of the first and second ends, resulting from high pressure fluid in contact with the high pressure fluid receiving surface region (of the body, and typically of the exterior of the body), between the said external seals.

When the first and second areas are approximately equal, the component of force due to fluid pressure acting on the high pressure fluid receiving surface region parallel to the cylinder axis in the direction of the first end is necessarily approximately equal to the component of force parallel to the cylinder axis in the direction of the second end, when the annular valve is closed, in use. Thus the net forces acting upon the cylinder body are reduced, and the cylinder body may be made with less material, and/or smaller than has previously been possible and may also be more easily retained within the fluid working machine (since there are lower net forces acting to force the cylinder assembly apart from the fluid working machine). The first area may be slightly less than (e.g. 1-5% less than) the second area, to facilitate insertion of the body into an aperture in the fluid working machine.

Typically, the first external seal has a first external circumferential dimension extending around the cylinder axis, and the second external seal has a second circumferential dimension extending around the cylinder axis (first and second external seals typically having the same shape and typically being circular and having respective first and second external circumferences), wherein the first and second circumferential dimensions are approximately equal. Typically, the high pressure fluid receiving surface region has a minimum of circumferential dimension intermediate the second external seal, which is different to (and preferably smaller than) the first and second circumferential dimension. The first external circumferential dimension may be slightly less than (e.g. 1-2.5% less than) the second external circumferential dimension.

According to a second aspect of the invention, there is provided a cylinder assembly comprising a cylinder body according to the first aspect, a first valve member (typically a poppet valve member) and a second, annular valve member; the first valve seat and the first valve member together forming a first valve (typically a poppet valve); and the second, annular valve seat and the second, annular valve member together forming a face sealing annular valve.

In some embodiments having a poppet valve, the poppet valve member is moveable axially in relation to the body and has an annular seat-engaging surface for sealing engagement with the poppet valve seat by axial movement of the poppet valve member towards the second end of the body, in use.

In some embodiments, the annular valve member is retained around a portion of the body, the said portion functioning as a cylindrical guide, to restrict radial motion of the annular valve member in relation to the body. Accordingly, the annular valve member is moveable axially in relation to the body and has at least one seat engaging surface for sealing engagement with a corresponding annular sealing surface by axial movement of the annular valve member towards the second end, in use.

In some embodiments, the annular valve comprises a tertiary valve member (for example a ball bearing, which may be provided with resilient biasing means, such as a coiled spring) associated with each said aperture and operatively connected to the annular valve member, each said tertiary valve member comprising a seat-engaging surface.

Preferably, an outer surface of the cylinder is a cylindrical guide for the annular valve member. In some embodiments, the cylinder assembly comprises a collar secured around the body between the annular valve seat and the first end, the collar comprising an end stop to retain the annular valve member around the cylinder body.

The first valve may be electronically controllable. In some embodiments, having a poppet valve, the poppet valve may be an electronically controllable poppet valve. Thus, the cylinder assembly or the poppet valve (or first valve) may further comprise a solenoid.

In some embodiments, the cylinder assembly comprises a flux bridge secured to the cylinder body between the poppet valve aperture and the second end of the body, the flux bridge having an internal diameter which is the same or smaller than the diameter of the poppet valve aperture. In some embodiments, the cylinder body comprises a flux bridge between the poppet valve aperture and the second end of the body, the flux bridge having an internal diameter which is the same or smaller than the diameter of the poppet valve aperture. Thus, the poppet valve may be assembled by introducing the poppet valve member from the first end of the body through the cylinder.

In some embodiments, the cylinder assembly has a high pressure fluid receiving surface configured to be in fluid communication with the high pressure manifold of a fluid working machine, in use; the high pressure fluid receiving surface comprising a region facing in a direction having a component towards the second end. The cylinder assembly may comprise more than one high pressure fluid receiving surface.

In use of the cylinder assembly in a fluid working machine, the cylinder assembly must typically withstand high, and in some cases extremely high, fluid pressures within the working chamber during normal operation of the fluid working machine. Fluid pressure thus applies forces on the cylinder assembly acting outwardly and towards the second end of the cylinder assembly, placing the cylinder body and other parts of the assembly under stress. The components of forces towards the second end of the cylinder assembly are further increased by the action of high pressure fluid from the high pressure manifold bearing on the annular valve member and thus the annular valve seat.

The cylinder assembly of the present invention is provided with a high pressure fluid receiving surface (or surface region, comprising one or more such surfaces), which is placed in fluid communication with a high pressure manifold, in use. Forces transmitted to the cylinder assembly by high pressure fluid on the region or regions of the high pressure fluid receiving surface (or surface region) facing in a direction having a component towards the second end will have a component towards the first end which opposes the components of force towards the second end resulting from fluid pressure bearing on the annular valve seat (and, at some stages during operation, resulting from high pressure within the working chamber). Consequently the net forces acting on the cylinder assembly are reduced.

The cylinder assembly may therefore be constructed using less material than has previously been possible. A smaller and more compact cylinder assembly enables the construction of a smaller and more compact fluid working machine. Furthermore, in embodiments having one or more electronically controlled valves, the reduction in the amount of material required to construct the cylinder assembly enables improved electromagnetic efficiency.

In some embodiments, the cylinder assembly comprises a collar secured around the body between the annular valve seat and the first end and the collar may comprise the said high pressure fluid receiving surface (or more than one, or all of the said surfaces, as the case may be). An external surface (or one or more external surfaces) of the collar may function as the (or each said) high pressure fluid receiving surface.

A cylinder assembly having a collar defining the high pressure fluid receiving surface or surfaces may be more easily assembled, particularly embodiments having an annular high pressure valve comprising an annular valve member. The cylinder body of such cylinder assemblies need not have an external surface or surfaces which increase in distance from the cylinder axis towards the first end (so as to function as a high pressure fluid receiving surface). For example, an annular valve member may be installed over the first end of the cylinder body, and a wider collar defining the high pressure fluid receiving surface may then be assembled around the body.

Typically, the exterior of the assembly comprises a high pressure fluid receiving surface region (comprising one or more high pressure fluid receiving surfaces) extending between a first external seal extending around the assembly between the annular valve seat and the first end, and a second external seal extending around the assembly between the annular valve seat and the second seal.

The said external seals describe a respective first area and second area, in projection on a plane perpendicular to the cylinder axis, wherein the first and second areas are approximately equal. Typically, the high pressure fluid receiving surface region has a minimum or maximum of area in projection on a plane perpendicular to the cylinder axis, between the said external seals, which is different to (and preferably smaller than) the first and second areas.

Preferably the second, annular valve is between the first and second external seals.

When the assembly is installed in a fluid working machine (typically as a component part of a cylinder assembly) the said external seals engage with the fluid working machine, optionally via a sealing member so as to bound the high pressure fluid receiving surface region of the exterior of the assembly, which is in fluid communication with the high pressure manifold, in use.

In use, the cylinder assembly receives components of force parallel to the cylinder axis in the direction of the first and second ends, resulting from high pressure fluid in contact with the high pressure fluid receiving surface region.

When the first and second areas are approximately equal, the component of force due to fluid pressure acting on the high pressure fluid receiving surface region parallel to the cylinder axis in the direction of the first end is necessarily approximately equal to the component of force parallel to the cylinder axis in the direction of the second end, when the annular valve is closed, in use. Thus the net forces acting upon the cylinder assembly are reduced, and the assembly may be made with less material, and/or smaller than has previously been possible, and may also be more easily retained within the fluid working machine. The first area may be slightly less than the second area (e.g. 1-5% less than the second area) to facilitate insertion of the body into an aperture in the fluid working machine.

Typically, the first external seal has a first external circumferential dimension extending around the cylinder axis, and the second external seal has a second circumferential dimension extending around the cylinder axis (first and second external seals typically having the same shape and typically being circular and having respective first and second external circumferences), wherein the first and second circumferential dimensions are approximately equal. Typically, the high pressure fluid receiving region has a minimum of circumferential dimension intermediate the second external seal, which is different to (and preferably smaller than) the first and second circumferential dimension. The first external circumferential dimension may be slightly less than (e.g. 1-2.5% less than) the second external circumferential dimension.

According to a third aspect of the invention there is provided a method of constructing a cylinder assembly according to the second aspect, comprising introducing a poppet valve member from the first end of a cylinder body according to the first aspect (and wherein the first valve seat is a poppet valve seat), and into the cylinder towards the second end.

The method may comprise introducing an annular valve member over a portion of the cylinder body from the first end. The method may further comprise introducing an annular valve member over a portion of the cylinder body from the first end and securing an annular collar around the body between the annular valve seat and the first end, the collar comprising an end stop to retain the annular valve member around the cylinder body.

In some embodiments, the method comprises introducing a flow guide or a valve movement guide, from the first end of the cylinder body and into the cylinder towards the second end.

When in use in a fluid working machine, fluid must at certain times be rapidly pumped from the working chamber through the poppet valve. Typically, fluid flows fastest in the gap between the poppet valve member and poppet valve seat, causing a kinetic energy related pressure drop between the poppet valve member and the poppet valve seat, which force acts to close the valve. Fluid shear and drag effects also act to urge the poppet valve closed against the flow of fluid, as described for example in international patent application number PCT/GB2009/051762.

A flow guide typically comprises a barrier upstream of the valve member to reduce one or more forces which would otherwise act on the valve member as a result of the flow of fluid to urge the valve member towards the valve seat.

A valve movement guide (which, in some embodiments also functions as, or comprises, a flow guide) is positioned between the working chamber and the poppet valve member to limit motion of the poppet valve member away from the cylinder axis. For example, the movement guide may comprise a formation with an axial aperture extending therethrough, in slideable engagement with a peg extending from the poppet valve member. A movement guide facilitates rapid opening and closing of the poppet valve without undesirable effects (such as excess wear) resulting from movement of the valve member away from the cylinder axis.

In some embodiments, the method comprises casting a single piece of metal. In some embodiments, the method comprises from a single piece of metal (which may be a casting), one or more of: the cylinder, the poppet valve seat, the annular valve seat, the poppet valve aperture, the apertures for an annular valve, the at least one annular sealing surface.

The method may comprise hardening the said piece of metal by one or more of: quenching, tempering, acid treatment.

According to a fourth aspect of the invention there is provided a fluid working machine comprising a high pressure manifold and a low pressure manifold and a cylinder assembly, the assembly comprising a body according to the first aspect, a first valve member and a second, annular valve member;

the second, annular valve seat and the annular valve member together forming a face sealing annular valve which regulates the flow of fluid from the high pressure manifold to the cylinder, the first valve seat and the first valve member together forming a first valve (typically a poppet valve seat and a poppet valve member forming a poppet valve) which regulates the flow of fluid between the cylinder and the low pressure manifold; and a reciprocating piston received within a cylinder defined by the body; characterised in that the body, comprising the first valve seat, the or each annular valve sealing surface and the cylinder, is a continuous unitary structure.

The fluid working machine may comprise a plurality of cylinder assemblies, and a reciprocating piston received within each said cylinder.

The or each said poppet valve (or first valve, as the case may be) may be electronically actuated. The or each said second, annular valve may be electronically actuated.

The invention also extends to a fluid working machine comprising a high pressure manifold and a low pressure manifold and at least one cylinder assembly according to the second aspect, wherein a reciprocating piston is received within each said cylinder; and wherein each said face sealing annular valve regulates the flow of fluid from the high pressure manifold to the respective cylinder, and each said poppet valve (or first valve, as the case may be) regulates the flow of fluid between the respective cylinder and the low pressure manifold.

Typically, each said piston of the fluid working machine is operable to undertake reciprocating motion within a respective cylinder along a piston axis extending from the first end to the second end of a respective cylinder body, and wherein the fluid working machine comprises first retaining means in engagement with each said cylinder assembly intermediate the first and second ends (most preferably near the first end) to resist forces (from the piston and/or fluid pressure within the working chamber) acting away from the piston axis.

Alternatively, or in addition the fluid working machine may comprise a second retaining means in engagement with each said cylinder assembly at or near the second end, to resist forces (from the piston and/or fluid pressure within the working chamber) acting along the piston axis (in the direction from the first to the second end). Preferably the second retaining means is closer to the second end than the first retaining means.

Thus, axial forces place each said cylinder assembly in compression (against the second retaining means) and greater forces may therefore be resisted by each said cylinder assembly than an assembly in a fluid working machine retained only at the first end, or retained so as to be placed in tension by the said axial forces. Typically it is more cost effective to retain the assembly in a fluid working machine against axial forces by second retaining means at the second end, and to retain the assembly in a fluid working machine against forces acting away from the piston axis (which, in some embodiments are radial forces) near the first end.

Placing the second retaining means at or near the second end makes the second retaining means easier to engage or disengage to facilitate inserting or removing the cylinder assembly from the fluid working machine. Placing the first retaining means intermediate the first and second ends, especially near the first end, provides for a more direct transference of forces acting away from the cylinder axis (caused by fluid pressure in the working chamber and, in some embodiments, the tilt of a piston therein during active cycles of the working chamber, causing net side loads on the cylinder assembly acting from within the working chamber) to the fluid working machine. Transference of the loads away from the cylinder axis (which are typically radial, for fluid working machines having working chambers arranged around a central rotating crankshaft or cam) to the fluid working machine (and typically the cylinder block, or the body of, the fluid working machine) at the second end would cause distortion of the cylinder body, thus potentially affecting the sealing ability of the annular valve member or poppet valve member.

In some embodiments, the fluid working machine comprises a cam operable to rotate in relation to the or each said cylinder, and the or each said piston comprises a cam engaging element to couple reciprocating motion of the or each said piston to rotation of the cam in relation to the or each said cylinder. Each said piston axis may be aligned along, or substantially along, a radius extending from the axis of rotation of the cam. Thus the first retaining means may resist forces (and thus prevent motion of the or each cylinder assembly) acting around the axis of rotation of the cam. The second retaining means may resist forces acting away from the axis of rotation of the cam (and thus prevent motion of the or each said cylinder assembly away from the cam).

In embodiments wherein a plurality of working chambers are disposed around a central cam, the second retaining means are positioned further from the axis of the cam than the first retaining means, where there is more space between the cylinder assemblies.

The first retaining means may comprise a bore (such as a cylindrical bore) extending into a part of the fluid working machine into which at least the first end of the body of the cylinder assembly is tightly insertable, and/or a formation (such as a cylindrical formation) at the first end of the body of the cylinder assembly which is tightly insertable into a part of the fluid working machine. The first retaining means may comprise screw threads or taper locks, or other formations to retain the cylinder assembly in the fluid working machine against forces along the piston axis. Preferably the first retaining means does not retain the cylinder assembly in the proximity of the second end. It may be that the first retaining means retains (for example cooperatively engages with) the cylinder assembly in the proximity of the first end, or only in the proximity of the first end.

The second retaining means may comprise a retaining fastening, or preferably a plurality of retaining fastenings arranged to retain the cylinder assembly in the fluid working machine against forces along the piston axis acting towards the second end of the cylinder assembly. In some embodiments, the second retaining means does not positively (i.e. by other than friction) retain the cylinder assembly against forces acting away from the piston axis. Preferably the retaining fastenings are screws or bolts.

Preferred and optional features of any one of the first, second or fourth aspects correspond to preferred and optional features of any other of the first, second or fourth aspects of the invention.

According to a fifth aspect of the invention there is provided a cylinder assembly for a fluid working machine, having a first end and a second end and comprising a cylinder body defining a cylinder, the cylinder having a cylinder axis and open to the first end of the cylinder body;

the cylinder assembly comprising a high pressure valve for regulating the flow of fluid between the cylinder and a high pressure manifold of a fluid working machine and a low pressure valve for regulating the flow of fluid between the cylinder and a low pressure manifold of a fluid working machine;

the high pressure valve comprising a high pressure valve seat facing in a direction having a component towards the first end, and a moveable high pressure valve member operable to sealedly engage with the high pressure valve seat and restrict fluid flow through the high pressure valve and into the cylinder, in use;

and the cylinder assembly having a high pressure fluid receiving surface (configured to be in fluid communication with the high pressure manifold of a fluid working machine, in use); characterised in that the high pressure fluid receiving surface comprises a region facing in a direction having a component towards the second end.

The invention also extends to a fluid working machine comprising a cylinder assembly of the fifth aspect.

In use of the cylinder assembly in a fluid working machine, a working chamber is defined by a reciprocating piston within the cylinder. The cylinder assembly must typically withstand high, and in some cases extremely high, fluid pressures within the working chamber during normal operation of the fluid working machine. Fluid pressure thus applies forces on the cylinder assembly acting outwardly and towards the second end of the cylinder assembly, placing the cylinder body and other parts of the assembly under stress. The components of forces towards the second end of the cylinder assembly are further increased by the action of high pressure fluid from the high pressure manifold bearing on the high pressure valve member and thus the high pressure valve seat.

The cylinder assembly of the present invention is provided with a high pressure fluid receiving surface (or, in some embodiments, surfaces), placed in fluid communication with a high pressure manifold, in use. Preferably the high pressure fluid receiving surface is in permanent fluid communication with the high pressure manifold. Forces transmitted to the cylinder assembly by high pressure fluid on the region of the high pressure fluid receiving surface facing in a direction having a component towards the second end will have a component towards the first end which opposes the components of force towards the second end resulting from fluid pressure bearing on the high pressure valve seat (and, at some stages during operation, resulting from high pressure within the working chamber). Consequently the net forces acting on the cylinder assembly are reduced. Preferably the high pressure fluid receiving surface is sized such that the force acting in the first direction and applied thereto by fluid in the high pressure manifold is substantially similar (by which we mean less than an approximately 10% difference, or in some embodiments less than an approximately 5% difference) to the force acting in the second direction and applied by fluid in the high pressure manifold to those parts of the cylinder body and high pressure valve which are in permanent fluid communication with the high pressure manifold.

The cylinder assembly may be constructed using less material than has previously been possible. A smaller and more compact cylinder assembly enables the construction of a smaller and more compact fluid working machine. Furthermore, in embodiments having one or more electronically controlled valves, the reduction in the amount of material required to construct the cylinder assembly enables improved electromagnetic efficiency.

In some embodiments, the high pressure fluid receiving surface is an external surface of the cylinder assembly. Typically, the distance between the high pressure fluid receiving surface and the cylinder axis increases towards the first end.

Preferably, the high pressure valve is an annular valve comprising an annular valve seat and an annular valve member slideably retained around the cylinder body, the annular valve seat comprising at least one sealing surface and a plurality of apertures in communication with the cylinder and providing a fluid pathway through the body, the apertures arranged around an axis extending between the first and second ends and each said aperture associated with a said sealing surface.

In some embodiments, the high pressure valve is a face sealing annular valve comprising at least one annular sealing surface and the annular valve member comprises at least one corresponding annular seat-engaging surface. In some embodiments, the high pressure valve comprises a tertiary valve member (for example a ball bearing, which may be provided with resilient biasing means, such as a coiled spring) associated with each said aperture and operatively connected to the annular valve member, each said tertiary valve member comprising a seat-engaging surface.

In some embodiments, the high pressure fluid receiving surface is an external surface of the body. In some embodiments, the cylinder assembly comprises a collar having a body engaging portion in cooperative engagement with a collar engaging portion of the cylinder body between the first and second ends of the cylinder body, the collar defining at least part of the high pressure fluid receiving surface.

A cylinder assembly having a collar defining the high pressure fluid receiving surface may be more easily assembled, particularly embodiments having an annular high pressure valve comprising an annular valve member. The cylinder body of such cylinder assemblies need not have an external surface or surfaces which increase in distance from the cylinder axis towards the first end. For example, an annular valve member may be installed over the first end of the cylinder body, and a wider collar defining the high pressure fluid receiving surface may then be assembled around the body.

In some embodiments, the collar may extend beyond the body engaging portion towards the first end and be spaced apart from the cylinder body. The space between the collar and the cylinder body may increase towards the first end. In some embodiments, a space between the collar and the cylinder body is in fluid communication with the high pressure fluid receiving surface, i.e. towards the second end. In some embodiments the body engaging portion may extend over a portion of the body extending from the annular valve seat, towards (or to) the first end (wherein the collar is not spaced apart from the body).

Accordingly, forces upon the high pressure fluid receiving surface are transmitted to the cylinder body at the collar engaging portion. Furthermore, components of force towards the cylinder axis, which would otherwise act to deform the internal dimensions of the cylinder, and cause a reciprocating piston within the cylinder to jam or pinch, are received by the collar in the portion where the collar and the cylinder body are spaced apart. Therefore, the portion of the cylinder body defining the cylinder and which is spaced apart from the collar need not be constructed with sufficient strength to resist such deformation, enabling less material to be used and for the cylinder assembly to be more compact than has previously been possible.

Preferably, there is no overlap between the region of the cylinder body defining the cylinder and the collar engaging portion of the cylinder body. Thus, components of forces received by the high pressure fluid receiving surface towards the cylinder axis are not transmitted to any part of the cylinder body within which a reciprocating piston operates, in use. Deformation of parts of the cylinder body other than the cylinder (and preferably also the high and low pressure valves) does not impair the function of the cylinder assembly and therefore separation of the portion of the cylinder body defining the cylinder from the collar engaging portion enables the construction of a smaller and more compact cylinder assembly, with less material and mass, than has been previously possible.

Preferably, the high pressure fluid receiving surface is between the first end of the cylinder assembly and the high pressure valve.

In some embodiments, the annular valve seat extends from a first circumferential dimension to a second circumferential dimension that is greater than the first circumferential dimension, the said apertures therebetween.

The first and second circumferential dimensions may be axially spaced apart.

Preferably, the annular valve comprises a first annular sealing surface having a first circumferential dimension and a second annular sealing surface having a second circumferential dimension which is greater than the first circumferential dimension, the said apertures therebetween.

Thus, forces transmitted to the cylinder body by fluid pressure impinging upon the annular valve member, when the annular valve is closed, comprise a component directed towards the second end and towards the cylinder axis. Therefore, in use, when fluid pressure within the working chamber is high, resulting forces transmitted to the cylinder assembly with components towards the second end and away from the cylinder axis are offset and the net forces received by the cylinder assembly are reduced.

Preferably, the cylinder assembly comprises an annular high pressure fluid receiving surface having a minimum circumferential dimension substantially equal to the first circumferential dimension, and a maximum circumferential dimension substantially equal to the second circumferential dimension.

Accordingly, forces resulting from high pressure fluid bearing on the high pressure valve towards the second end are substantially equal to forces resulting from high pressure fluid bearing on the annular high pressure fluid receiving surface towards the first end.

The cylinder assembly may comprise more than one high pressure fluid receiving surface having a region facing in a direction having a component towards the second end.

Preferred and optional features of any one of the first through fifth aspects correspond to preferred and optional features of any other of the first through fifth aspects of the invention.

BRIEF DESCRIPTION OF DRAWINGS

An example embodiment of the present invention will now be illustrated with reference to the following Figures in which.

DESCRIPTION OF EMBODIMENTS

Figure 1:
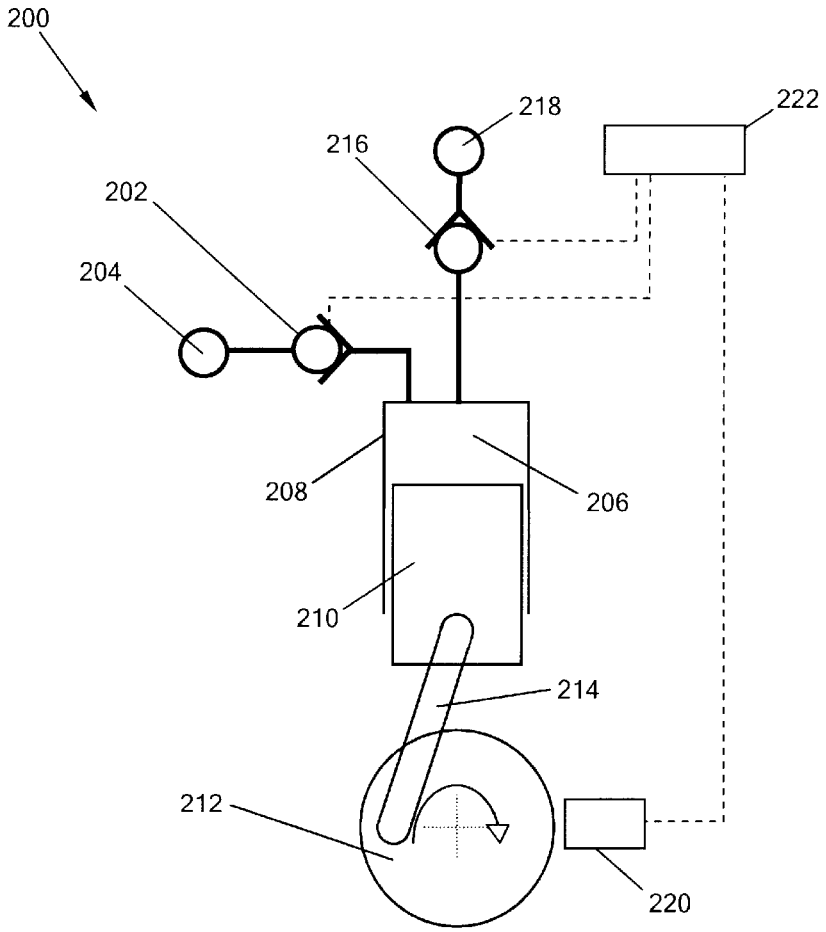
FIG. 1 is a schematic diagram of a fluid working machine.
Figure 2:
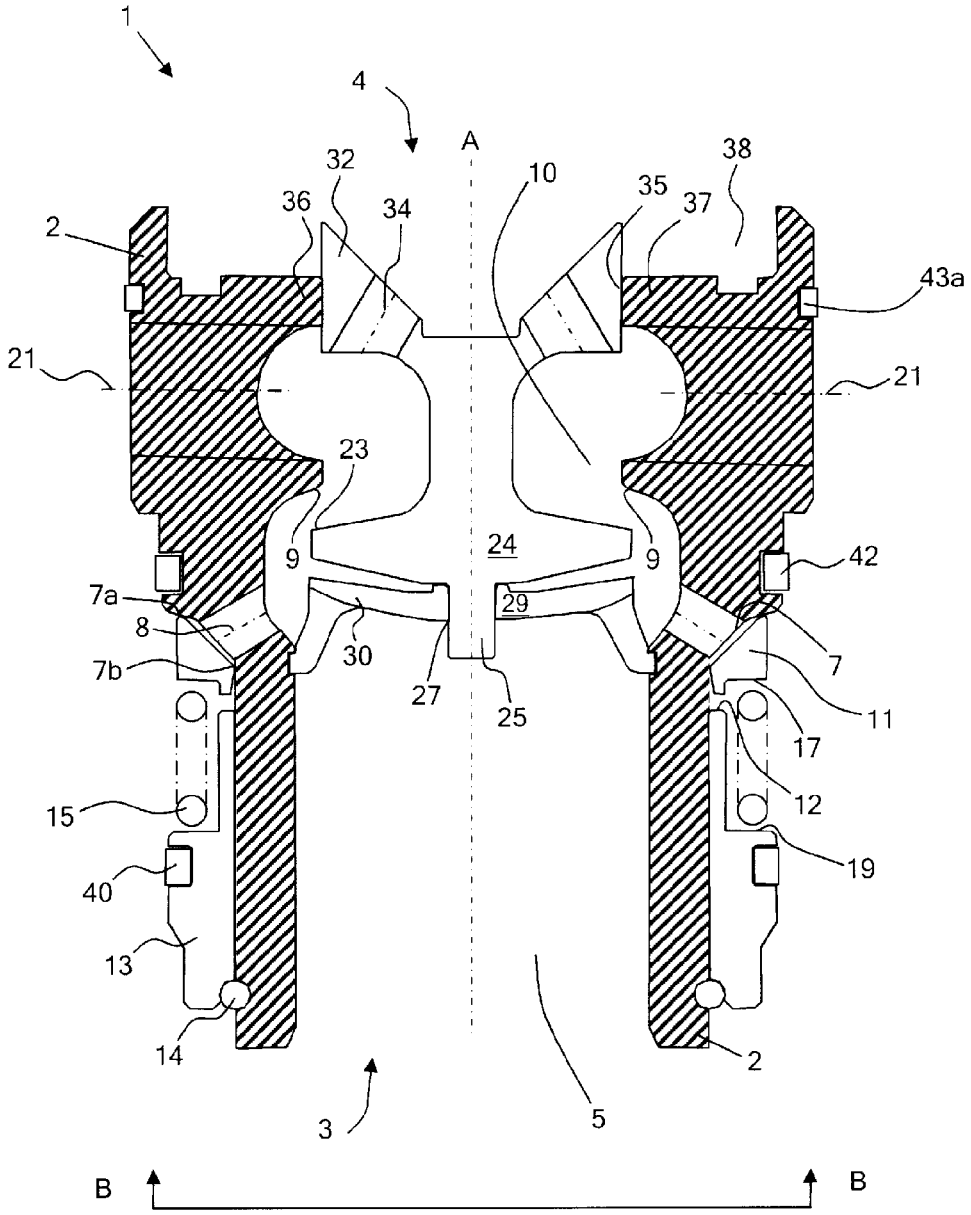
FIG. 2 is a cross sectional view of a cylinder assembly.

FIG. 2 shows a cylinder assembly 1, comprising a body 2, for use with a fluid working machine of the general type shown in FIG. 1.

The body is generally cylindrically symmetric around the cylinder axis A and comprises a cylinder 5 which is open to a first end 3 of the body, an annular valve seat 7 (functioning as the second valve seat and defining a plurality of apertures 8 arrayed around and extending through the body) and a poppet valve seat 9, functioning as the first valve seat and defining a poppet valve aperture 10 (functioning as the first valve aperture and providing a fluid pathway between the cylinder and radial passages 21 extending through an upper portion of the body). At the opposite end to the first end 3 the body has a second end 4.

The cylinder body is cast or forged from a single piece of material and the valve seats, cylinder and seals subsequently machined. Some parts (i.e. the portion of the body defining the cylinder, and the valve seats), or optionally all, of the body may then be subjected to hardening treatments, such as tempering and quenching treatments. In an alternative embodiment, the body is machined (e.g. CNC machined from a single block of hardened materials such as hardened steel).

Optionally, hardened and/or low friction coating may be applied to the inner surface of the cylinder and the valve seats.

Since the body has a unitary construction, and comprises all of the parts and surfaces requiring hardening treatment or coating, or which must be composed of a hardened material, the cylinder body may be constructed more economically than has previously been possible, since fewer parts must be so treated. Furthermore, by virtue of having no joins or welds, the body is stronger (and may thus be constructed to withstand given forces using less material) than has previously been possible.

An annular valve member 11, functioning as the second, annular valve member, is retained around the body between the annular valve seat and the end stop 12 of the collar 13. The annular valve seat and the annular valve member together form an annular valve, biased in a closed position (with the annular valve member abutting the annular valve seat, as shown) by coiled spring 15 which extends between the lower face 17 of the annular valve member and an opposed upper face 19 of the collar. In use, under force of fluid pressure from inside the cylinder exceeding the pressure surrounding the annular valve member, the annular valve member is operable to move axially, so as to abut the end stop, so as to open the annular valve such that fluid can flow between the cylinder 5 and the area surrounding the annular valve member 11 (which is in communication with a high pressure manifold as described below with reference to FIG. 3).

In the closed position shown in FIG. 2, the annular valve member forms an outer seal 7*a*, and an inner seal 7*b* against a part of the outer surface of a portion of the body defining the cylinder. The inner and outer seals are axially spaced apart such that the annular valve seat is generally frustoconical and faces in a direction away from the cylinder axis and angled towards the first end (the lower end as viewed in the figures) of the cylinder body. The circumference of the inner seal is equal to the circumference of the part of the body defining the cylinder (and thus the minimum circumference of the end stop 12) and the circumference of the outer seal is approximately equal to the outer circumference of upper face 19 of the collar.

The collar is held in place by retaining ring 14. In an alternative embodiment, the collar tapers away from the body towards the first end (and the retaining ring) such that forces applied to the outside of the collar are not transmitted to at least a portion of the body defining the cylinder, and cause the cylinder body to distort, for example in the part of the body defining the cylinder (which might otherwise lead to "pinching" or trapping of the piston). The collar may be provided with an interference fit around the cylinder for a part, or all, of the depth of the collar. More typically, the collar and cylinder body are cooperatively engaged, for ease of installation within the cylinder block and removal of the collar, annular high pressure valve and spring.

The assembly further comprises a poppet valve member which, together with the poppet valve seat and poppet valve aperture, forms a poppet valve for controlling the flow of fluid between radial passages 21 (and thus the low pressure manifold) and the cylinder 5. The poppet valve member is operable to move along the axis A, such that the poppet valve may be moved between an open position (as shown) and a closed position where the sealing surface 23 (an annular region on an upper face of the head portion 24 of the poppet valve member) is in contact with the poppet valve seat.

The poppet valve member is provided at its lower end with a peg 25, which is in slideable engagement with a central aperture 27 in lower guide structure 29. The lower guide structure comprises and is held in place by radial struts 30 extending to the inner walls of the cylinder and, in use, functions to restrict movement of the peg away from the cylinder axis and to form a partial barrier to protect or isolate fluid flow between the cylinder and the low pressure manifold from the poppet, which would otherwise act to urge the poppet valve closed.

Figure 3:
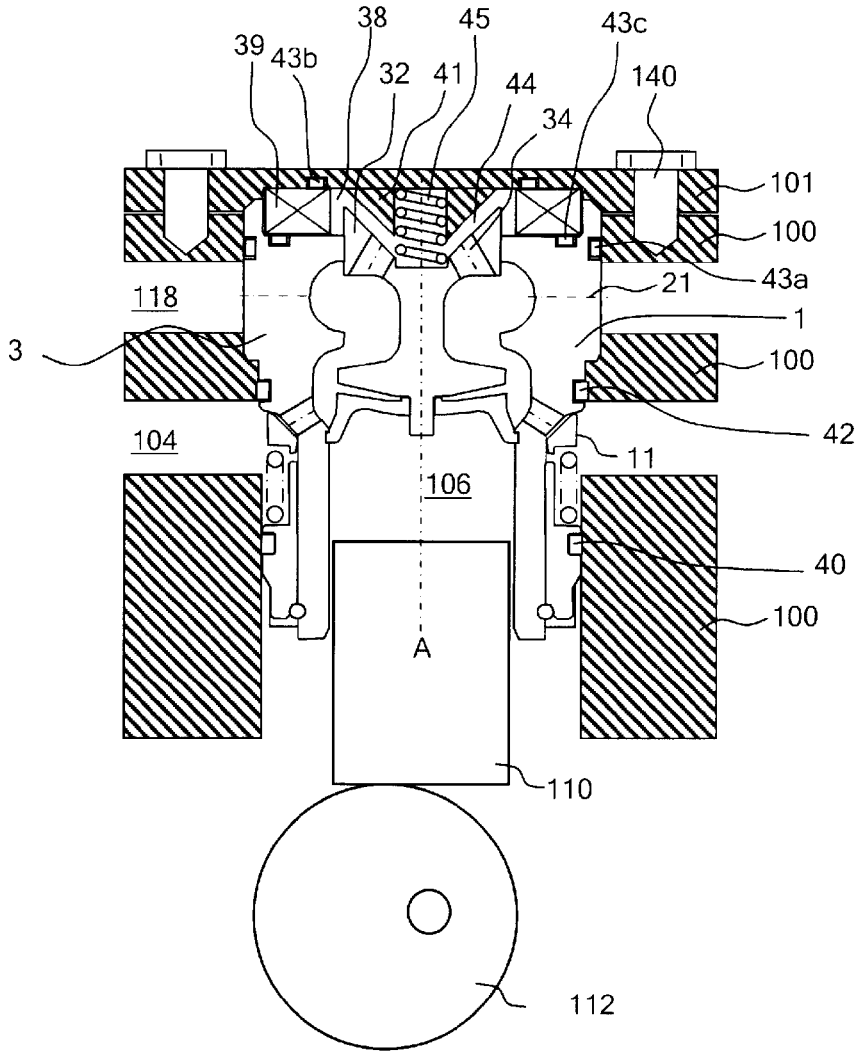
FIG. 3 is a cross sectional view of a portion of a cylinder block of a fluid working machine.

At its upper end, the poppet valve member is provided with an armature 32, comprising passages 34 extending between upper and lower faces of the armature, placing radial passages 21 in fluid communication with coil space 38 (which is sealed by a top plate 101 to form a space for coil 39, as shown in FIG. 3 and mentioned below).

The outer face of the armature is slideably engaged with the inner face 35 of upper guide structure 36.

Lower high pressure seal 40 (functioning as the first external seal) extends around a channel provided in the collar, and upper high pressure seal 42 (functioning as the second external seal) extends around a similar channel provided in the body, above the annular valve seat. In use, the region of the cylinder assembly intermediate the upper and lower high pressure seals is brought into communication with the high pressure manifold 204 of a fluid working machine, and the seals prevent egress of high pressure fluid beyond this region. First low pressure seal 43*a* extends around a channel provided in the body above the radial passages 21, which are in fluid communication with the low pressure manifold 218 of a fluid working machine. The seals 40, 42, 43*a* are of similar diameter to one another, however seal 43*a* is slightly greater in diameter than seal 42 and seal 42 is slightly greater in diameter than seal 40, so as to facilitate insertion of the cylinder assembly into the fluid working machine.

In the embodiment shown, the poppet valve is adapted to be electronically controllable (by means of a solenoid coil 39 and an electronic controller, not shown).

The diameter of the inner face 35 of upper guide structure 36 is sized to slideably receive the armature, at the upper end of the poppet valve member. The largest diameter portion of the head portion of the poppet valve member is also smaller than the inner diameter of the cylinder, and so the poppet valve member may be introduced through the open (first) end of the cylinder during installation, and subsequently retained in place by the lower guide structure. The upper guide structure also acts as a flux bridge 37 for communicating magnetic flux, caused by the energising of a coil 39 occupying coil space 38, from the body 3 to the armature.

The outer surface of the portion of the body defining the cylinder is cylindrical and has a constant diameter over the length of the cylinder body between the annular valve seat and the first end. Thus, the annular valve member may be introduced around the body from the open end of the cylinder, and the collar (together with the coiled spring) subsequently introduced over the body so as to limit the range of axial motion of the annular valve member, and the collar retained in place around the body, by the retaining ring.

Accordingly, the cylinder assembly may be quickly and economically assembled by securing all parts to the body from one end. The geometry and configuration of the cylinder body permitting installation from one end also enables the cylinder body to be a single unitary construction (as compared to known devices which are made in several parts which must be connected together, in order that (for example) the valve members can be installed).

The cylinder assembly can also be readily disassembled, in order to replace worn parts of the annular valve and poppet valve independently. In comparison, for maintenance of known devices, it may be necessary to disassemble both valves, and/or the body, in order to access one or other of the valves or replace them in the event that it is not known which one is faulty.

FIG. 3 shows the cylinder assembly installed in (a portion of) a cylinder block 100 of a fluid working machine of the type discussed above.

The cylinder assembly is cooperatively received within a recess in the cylinder block, such that lateral forces (i.e. away from the cylinder axis) which result from the upward motion of the piston are resisted. Thus, the recess functions as a first retaining means to resist forces acting away from the piston axis.

The cylinder assembly is retained at its upper end by top plate 101, which is secured to the cylinder body by screws 140. Thus, in use, forces acting upward (in the orientation as shown in the figures) and resulting from high pressure fluid within the working chamber are resisted by the top plate (functioning as a second retaining means), and the cylinder body is thus placed into compression. The cylinder assembly retained at its upper end is better able to resist forces resulting from high pressures in the working chamber than components of known fluid working machines having retaining means (for some or all of the parts of a cylinder assembly) to the side of the assembly. Such devices must resist high pressures in the working chamber which place at least the upper part of the assembly in tension, and must therefore be constructed using more material than is necessary for the cylinder assembly of the present invention, and can be more expensive to produce. Furthermore, in fluid working machines comprising a plurality of working chambers extending radially from a central rotating cam, retaining means positioned at the upper (or outer) end of the assembly enable adjacent cylinder assemblies to be placed closer together, than would be the case where retaining means are provided to the side of the assemblies and thus closer to the cam.

The cylinder assembly may be quickly and economically dropped into and lifted from the cylinder block, for maintenance or replacement, as a single unit following removal of the top plate.

As mentioned above, coil space 38 is defined by the top plate 101 and the body 3. A frustroconically shaped pole 41 also extends into the coil space and together with the armature 32 defines a flux gap 44 therebetween. On activation of the coil 39, flux circulates through the body, exiting radially through upper guide structure 36 into the armature, crosses the flux gap to enter the pole, and passes through the top plate to re-enter the body. As a consequence, the armature is attracted across the flux gap to the pole and the valve is closed. In other embodiments there is provided an electromagnetic latch to hold the valve in either the open or closed positions, such latch being overcome or defeated by the solenoid. A spring 45 or some other resilient member is provided between the top plate and the armature to urge the armature towards the first end, until it abuts the guide structure 29, i.e. to the open position. First and second coil seals 43*b* and 43*c* lie between the coil and the top plate and body respectively to prevent fluid from escaping from the fluid working machine.

When the poppet valve (which is electronically controllable and thus may be actuated very rapidly) is opened and closed, fluid is flushed into and out of the flux gap, through the passages 34 in the armature 32. The fluid drag thus generated is typically very much smaller than the magnetic force applied to the poppet valve member by the coil, such that the valve may still be actuated rapidly. However, in order to close the poppet valve, the solenoid may be deactivated, or the current within the solenoid reduced, fractionally before the valve member contacts the poppet valve seat to reduce the peak impact force of the valve member against the seat.

Radial channels 21 are in fluid communication with low pressure manifold 118 (such that, when the poppet valve is in an open configuration, as shown, the working chamber 106 defined by the reciprocating piston 110 and the cylinder, is in fluid communication with the low pressure manifold via the poppet valve aperture 10) and annular valve apertures 8 are in fluid communication with the working chamber and the high pressure manifold 104 (when the annular valve member is in an open configuration). The high and low pressure manifolds typically comprise annular galleries that surround the valve bodies and communicate with their respective apertures, and typically extend to a plurality of other valves.

In use, when the annular valve is closed (as shown) and fluid pressure in the working chamber is lower than the pressure of the high pressure manifold, fluid pressure acting on the annular valve member transmits to the body a force with a radial component acting towards the cylinder axis and an axial component upwards (i.e. away from the cam 112, towards the second end).

The end stop 12 and upper face 19 of the collar are also exposed to high pressure fluid, and fluid pressure transmits to the body an axial component of force downwards (in the orientation of the cylinder assembly shown in the figures) and towards the cam. Thus, the end stop and upper face of the collar act as high pressure fluid receiving surfaces.

Figure 4:
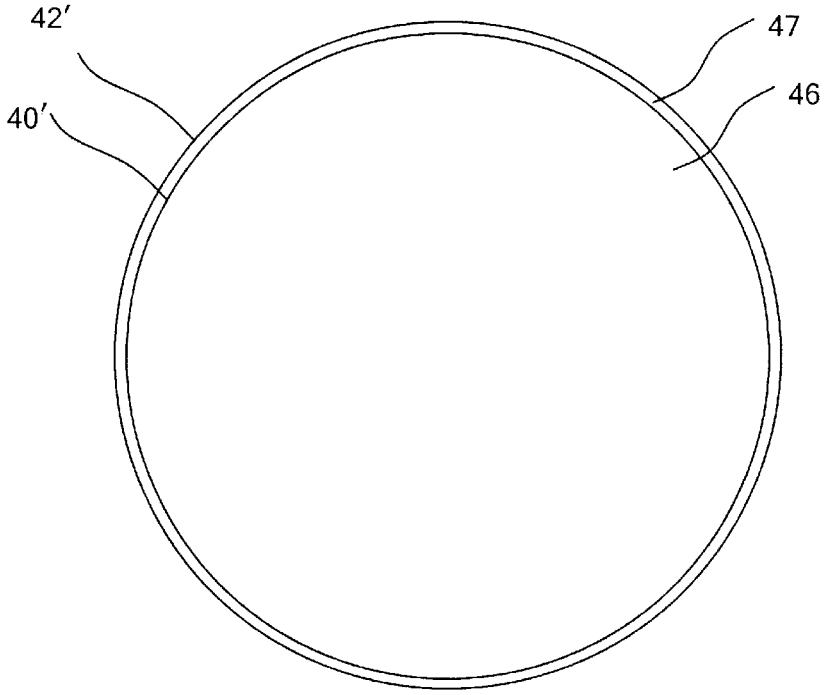
FIG. 4 is a projection of the outer periphery of the lower and upper high pressure seals on plane B-B.

As mentioned above, the circumferences of lower high pressure seal 40 and upper high pressure seal 42 are approximately equal. FIG. 2 illustrates plane B-B which and is perpendicular to the cylinder axis. FIG. 4 illustrates the projections 40', 42' of the seal formed by the lower high pressure seal and upper high pressure seal and the areas 46, 47 described by the lower and upper high pressure seals in projection on plane B-B (functioning as the first and second areas respectively). Area 46 is the area of circle 40' and area 47 is the area of circle 42'. It can be seen that the areas are approximately equal, although the area formed by the lower high pressure seal in projection on plane B-B is slightly less than the area formed by the upper high pressure seal in projection on plane B-B to enable axial insertion of the cylinder assembly into a chassis and retention by an interference fit.

Therefore, the axial components of forces resulting from high pressure fluid acting upward on the annular valve member and valve body, and downward on the collar, are of substantially equal magnitude and so approximately cancel one another. Consequently, the screws 140 need not be able to withstand forces resulting from fluid pressure on the annular valve member, and so they, and the whole cylinder assembly can be made smaller and lighter than has previously been possible. Fluid pressure still applies axial force to the valve body via the poppet valve and poppet valve seat, however the magnitude of the net forces which the cylinder body and cylinder assembly (and thus also the screws 140) are subjected to is substantially reduced as a consequence of the high pressure fluid receiving surface of the collar.

The terms upper and lower, and other terms concerning orientation and direction, relate to the apparatus having the orientation shown in the figures and herein described, and are intended to describe the relative position or the respective integers regardless of the orientations of the apparatus in use.

The arrangement of the annular valve member around the cylinder body, with the annular valve seat having apertures extending through the cylinder body provides a very compact valve arrangement, enabling a more compact fluid working machine to be provided.

The cylinder body and cylinder assembly of the invention is suitable for use in fluid working machines having any or a wide variety of piston types, for example pistons comprising piston rings, pistons which remain substantially aligned with the cylinder axis and/or pistons whose axis remains aligned with a rotating eccentric cam and thus not aligned with the cylinder axis; and piston driving means such as eccentric cams onto which the pistons or piston-engaging rings are urged by the action of springs or fluid pressure from within the working chamber, or eccentrics to which pistons are engagingly held.

Further variations and modifications can be made within the scope of the invention herein disclosed.

REFERENCE SIGNS LIST

1 Cylinder assembly
2 Body
3 First end
4 Second end
5 Cylinder
7 Second valve seat (annular valve seat)
7*a* Outer seal
7*b* Inner seal
8 Apertures
9 First valve seat (poppet valve seat)
10 First valve aperture (poppet valve aperture)
11 Annular valve member (second, annular valve member)
12 End stop
13 Collar
14 Retaining ring
15 Spring
17 Lower face
19 Upper face
21 Radial passages
23 Sealing surface
24 Head portion of poppet valve member
25 Peg
27 Central aperture
29 Lower guide structure
30 Radial struts
32 Armature
34 Passages
35 Inner face
36 Upper guide structure
37 Flux bridge
38 Coil space
39 Solenoid coil
40 First external seal (lower high pressure seal)
40' Projection of first external seal (lower high pressure seal) on plane B-B
41 Pole
42 Second external seal (upper high pressure seal)
42' Projection of second external seal (upper high pressure seal) on plane B-B
43*a* First low pressure seal
43*b* First coil seal
43*c* Second coil seal
44 Flux gap
45 Spring
46 First area
47 Second area
100 Cylinder block
101 Top plate
104 High pressure manifold
106 Working chamber
110 Reciprocating piston
112 Cam
118 Low pressure manifold
140 Screws
200 Fluid working machine
202 High pressure valve
204 High pressure manifold
206 Working chamber
208 Cylinder
210 Piston
212 Cam
214 Connecting rod
216 Low pressure valve
218 Low pressure manifold
220 Shaft angle sensor
222 Controller

The invention claimed is:

1. A cylinder assembly for a fluid-working machine, comprising:

a cylinder body;

a first valve having a first valve member; and a second, face-sealing annular valve having a second, annular valve member;

the body having a first end and a second end and comprising a cylinder, a first valve seat and a second, face-sealing annular valve seat;

the cylinder open to the first end and configured to receive a reciprocating piston;

the first valve seat extending around a cylinder axis extending between the first and second ends and comprising one or more first valve apertures, the or each first valve aperture extending through the body and in communication with the cylinder and providing a fluid pathway through the body;

the second, annular valve seat comprising at least one annular sealing surface and a plurality of apertures for an annular valve, each aperture associated with a said sealing surface; wherein the apertures of the second, annular valve seat are arranged around the cylinder axis and in communication with the cylinder, and provide a fluid pathway through the body;

the first valve seat and the first valve member together forming the first valve; and the second, annular valve seat and the second, annular valve member together forming the second, face-sealing annular valve around the cylinder body.

2. A cylinder assembly according to claim 1, wherein the body, comprising the or each annular valve sealing surface and the first valve seat and the cylinder, is a continuous unitary structure.

3. A cylinder assembly according to claim 2, wherein the body is a metal casting or is machined from a single piece of material.

4. A cylinder assembly according to claim 2, wherein the body is formed of hardened steel.

5. A cylinder assembly according to claim 1, wherein the cylinder, first valve seat and second, annular valve seat are coaxial.

6. A cylinder assembly according to claim 1, wherein the first valve seat is a poppet valve seat, having a single sealing surface and defining a poppet valve aperture extending through the body and in communication with the cylinder; and wherein the body, comprising the or each annular valve sealing surface and the poppet valve seat and the cylinder, is a continuous unitary structure.

7. A cylinder assembly according to claim 6, wherein the poppet valve seat has a smaller circumference than the or each annular valve sealing surface.

8. A cylinder assembly according to claim 6, wherein the maximum diameter of the poppet valve aperture is equal to or smaller than the minimum internal diameter of the cylinder.

9. A cylinder assembly according to claim 6, further comprising a flux bridge extending around the cylinder axis, the flux bridge having an internal diameter which is smaller than the diameter of the poppet valve aperture.

10. A method of constructing the cylinder assembly according claim 6, comprising introducing the poppet valve member from the first end of the cylinder body, and into the cylinder towards the second end.

11. A method according to claim 10, further comprising introducing the annular valve member over a portion of the cylinder body from the first end.

12. A method according to claim 10, further comprising introducing the annular valve member over a portion of the cylinder body from the first end and securing an annular collar around the body between the annular valve seat and the first end, the collar comprising an end stop to retain the annular valve member around the cylinder body.

13. A method according to claim 10, further comprising introducing a flow guide or a valve movement guide, from the first end of the cylinder body and into the cylinder towards the second end.

14. A fluid working machine comprising a high pressure manifold and a low pressure manifold and at least one cylinder assembly according to claim 6, wherein a reciprocating piston is received within each said cylinder; and wherein each said face sealing annular valve is configured to regulate the flow of fluid from the high pressure manifold to the respective cylinder, and each said poppet valve is configured to regulate the flow of fluid between the respective cylinder and the low pressure manifold.

15. A fluid working machine according to claim 14, wherein each said piston is operable to undertake reciprocating motion within said respective cylinder along a piston axis extending from the first end to the second end of a respective cylinder body, and wherein the fluid working machine comprises first retaining means in engagement with each said cylinder assembly at or near the first end, to resist forces acting away from the piston axis.

16. A fluid working machine according to claim 14, wherein each said piston is operable to undertake reciprocating motion along a piston axis extending from the first end to the second end of a respective cylinder body, and wherein the fluid working machine comprises second retaining means in engagement with each said cylinder assembly at or near the second end, to resist forces acting along the piston axis.

17. A cylinder assembly according to claim 1, wherein one or more surfaces of the body are provided with a friction reducing or hard coating.

18. A cylinder assembly according to claim 1, wherein the exterior of the body comprises a high pressure fluid receiving surface region extending between a first external seal extending around the body between the annular valve seat and the first end, and a second external seal extending around the body between the annular valve seat and the second end; said first and second external seals describing a respective first area and second area in projection on a plane perpendicular to the cylinder axis;

wherein the first and second areas are approximately equal.

19. A cylinder assembly according to claim 1, wherein an outer surface of the cylinder is a cylindrical guide for the second, annular valve member.

20. A cylinder assembly according to claim 1, further comprising a collar secured around the body between the second, annular valve seat and the first end, the collar comprising an end stop to retain the second, annular valve member around the cylinder body.

* * * * *